US005349338A

United States Patent [19]

Routman et al.

[11] Patent Number: 5,349,338

[45] Date of Patent: Sep. 20, 1994

[54] FIRE DETECTOR AND ALARM SYSTEM

[76] Inventors: Brent E. Routman, 106 McNutts Creek Ct., Athens, Ga. 30606; Larry W. Stults, 2565 Cardinal Lake Cir., Duluth, Ga. 30136

[21] Appl. No.: 12,497

[22] Filed: Feb. 2, 1993

[51] Int. Cl.[5] ..... G08B 17/00; G08B 3/00

[52] U.S. Cl. ..... 340/692; 340/584; 340/628

[58] Field of Search ..... 340/692, 584, 628

[56] References Cited

U.S. PATENT DOCUMENTS

| | | | |
|---|---|---|---|
| 4,288,789 | 9/1981 | Molinick et al. | 340/692 |
| 4,453,222 | 6/1984 | Goszyk | 340/628 |
| 4,754,266 | 6/1988 | Shand et al. | 340/691 |
| 4,894,642 | 1/1990 | Ashbaugh et al. | 340/692 |
| 4,904,983 | 2/1990 | Mitchell | 340/426 |
| 4,904,988 | 2/1990 | Nesbit et al. | 340/628 |

*Primary Examiner*—Glen Swann
*Attorney, Agent, or Firm*—Larry W. Stults

[57] ABSTRACT

A fire alarm system having recorded vocal warning messages and/or instructions is provided. The fire alarm system has a microphone by which a user can record a vocal message specifically suited for a small child or adult in need of verbal instructions. This allows the person hearing the warning message to respond correctly and quickly to a fire alarm. This recorded vocal message can be transmitted in combination with a fixed alarm signal in response to the detection of a fire condition. In a preferred embodiment a fire condition detector 10 is controlled by a CPU 65. Upon initial power-up, the combined watch-dog timer and power-on-reset circuitry 80 resets CPU 65 permitting it to execute machine instructions stored in ROM 95. User commands are issued via switch 75. The user speaks into microphone 25, which applies an audio signal to the microphone amplifier 125, which sends an analog signal to the analog-to-digital converter 130, which in rum sends a digital signal to CPU bus interface 135 for storage in RAM 90. CPU 65 monitors the output of fire condition detector means 10. Upon detection of a fire condition, detector means 10 activates the alarm state. CPU 65 then transfers the pre-recorded digital information from RAM 90 to the digital-to-analog CPU bus interface 40, which in turn provides a analog signal to amplifier 50, and ultimately loudspeaker 60.

7 Claims, 6 Drawing Sheets

FIRE DETECTOR AND ALARM SYSTEM

TECHNICAL FIELD

This invention relates to fire safety devices and more specifically to smoke and heat detectors capable of recording vocal warnings and playing them back as part of the alarm signal that is triggered by the detection of a fire condition.

BACKGROUND OF THE INVENTION

There are many prior art smoke or heat detectors of all types, and it is documented that the use of these detectors saves lives as a result of an early warning of a fire condition. However, despite the use of smoke or heat detectors, many lives still are lost in fires due to smoke inhalation and burns. Tragically, this is particularly true for small children.

Annually, four to five thousand persons lose their lives in the United States as a result of an estimated half-million residential fires. Residential fires account for seventy-eight percent of all fire deaths in the United States and occur every sixty-six seconds. An additional twenty to thirty thousand other persons are injured in those fires. Statistics demonstrate that children younger than five years of age are twice as likely to die in a fire than the rest of the population. Each year 1,200 children age 0–14 die in residential fires with more than sixty percent of these children being under the age of five with 11,400 other children being injured. Each day, an average of three children die in a residential fire.

It is well established that the risk of dying in a fire is cut in haft in a home with a working smoke detector. Close to ninety percent of children die in home fires where working smoke detectors were not present. However, ten percent of the child deaths occur in home fires where the homes had a working smoke detector. Despite the abundance of smoke detectors and smoke alarms on the market in the United States, and in the homes of young children, approximately 120 children die at home each year needlessly. Many of these children die not as a result of a malfunctioning or non-functioning smoke alarm and detector but rather due to "their reactions to fire." (National Safe Kids Campaign.) Children do not commonly or instinctively know to leave a burning building even at the sounding of the conventional smoke or fire detectors. In fact, the loud warning given by available smoke and heat warning systems may contribute to a child's fear and inability to adequately respond to a dangerous situation.

All too often it is reported that a child has died as a result of hiding under a bed or in a closet believing that he is safe from the fire or that he can control the fire. The Safe Kids Campaign specifically suggests that "younger children are afraid of the very things and people that could save them . . . the sound of the smoke detector, fire alarm or fire engine sirens can scare children. Often children will not leave with the firefighter—waiting instead for their parents to rescue them." (Emphasis added). In a critical fire situation, each second counts: an entire home can be engulfed in flames in five minutes; it only takes three minutes for a room to "flashover," or get so hot that it bursts into flames; and inhaling very hot air just once can cause severe lung damage. Time is critical and children need to respond correctly to a fire alarm warning immediately. Confusion, fear, or inaction often results in severe injuries and can be lethal.

Although smoke and heat detectors currently available perform a great service in alerting most adults to the danger of a fire, the mere sounding of an alarm or horn cannot sufficiently protect young children and the elderly or other adults who do not comprehend the significance of an alarm signal, who do not understand what to do in response to an alarm signal, or who become panicky and react erroneously or irrationally to an alarm signal.

Essentially all smoke and heat detectors currently used in residential homes emit a loud, shrieking alarm designed to command the attention of everyone within hearing of the device. Alarm signals, however, provide nothing more in the way of information useful for exiting the structure, avoiding injury, or preventing death. Moreover, the very nature of alarm signals currently used, i.e., loud shrill horns or buzzers, while often effective for most adults, frequently serves only to scare, confuse, and panic small children and the elderly. Thus, a major problem associated with small children's and elderly adults' ability to comprehend the meaning of an alarm signal, to understand what to do in response to an alarm signal, and to correctly react to an alarm signal, is the alarm signal itself. A smoke or heat detector and alarm system that transmits merely a loud tone alone is not optimal or even sufficient for the protection of small children and elderly or other adults who are easily confused by such alarms.

There has been a long-felt need for a smoke or heat detector and alarm for home use that is effective for adults, the elderly and particularly small children, one which provides verbal warning messages and/or instructions for these individuals to follow. The continued injury and mortality of small children in fires, despite the existence and use of currently available smoke detectors, demonstrates this need. U.S. Pat. No. 4,754,266 to Shand et al. describes a traffic director that transmits audio exit cues to occupants of a structure in response to the detection of a fire condition. The disclosed device, however, provides no means for recording personalized vocal messages from a parent or guardian directed to a small child or adult containing specific instructions on how to respond to detected fire condition. U.S. Pat. No. 4,904,983 to Mitchell discloses a movable vehicle alarm system for detecting and deterring theft of automotive tape recorders.

An effective residential smoke or heat detector and alarm should be simple, reliable, economical, compact, and easy to install. It should transmit an alarm signal that readily alerts small children to fire danger and conveys simple instructions that small children can understand easily and to which they are likely to respond. A small child most easily understands, and is most likely to respond to, the voice and instructions of his or her parents or other trusted adult.

There is a need, therefore, for a reliable, inexpensive and easy-to-install smoke or heat detector and alarm capable of recording a familiar adult's verbal warning message and instructions to a small child and transmitting that warning message and instructions as part of an alarm signal in response to the detection of a fire condition. Such a system would provide unique warning messages and instructions that are specifically suited for small children, and would increase the likelihood that small children would understand and correctly respond to the alarm signal, thus saving more small children from tragic, untimely, and unnecessary death due to fire and smoke inhalation.

SUMMARY OF THE INVENTION

The present invention provides an improved fire detector and alarm having as all or part of its alarm signal a recorded vocal warning messages and/or instructions. The fire alarm system of the present invention a microphone and recording means by which an end user, e.g. the parent of a small child, can record a vocal warning message specifically suited for a small child. The present invention also encompasses means by which the recorded warning message can be transmitted in combination with a fixed alarm signal. The transmission of the warning message and fixed alarm signal is activated by the detection of a fire condition in the vicinity of the fire condition detector.

More specifically, the present invention includes means for supplying electrical power, a fire condition detector, means for recording a vocal message, an alarm signal activated by a signal from the fire condition detector, and playback means for transmitting the recorded message as part of the alarm signal. The fire condition detector and alarm of the present invention may optionally have a fixed alarm signal in addition to the recorded warning message. Such an alarm signal would consist of both a fixed signal and the recorded warning message, which may be transmitted in an alternating and repeating manner.

A preferred fire alarm system of the present invention comprises a smoke detector that generates an activating signal: a microphone, analog to digital converter and RAM for recording a warning message: a ROM for storing and providing instruction to a processor that receives the activating signal from the smoke detector, which in turn provides the digitized warning message to a digital to analog converter, amplifier and loudspeaker for playback of the warning message.

It is an object of the present invention to provide a fire condition detector and alarm signal for home, day care and nursing home use that is effective for alerting small children and other adults of a fire condition in the local vicinity, wherein the alarm signal can easily understand and is likely to elicit a response from people, particularly small children.

It is a further object of the present invention to provide a fire condition detector capable of recording a vocal warning message and vocal instructions from someone whose voice a small child would recognize and transmitting the vocal warning message and/or vocal instructions as all or part of the fire alarm signal.

It is yet a further object of the present invention to provide a compact fire condition detector and alarm that is easy to install so that it may be placed in the bedroom, playroom, or hallways outside rooms that small children frequent.

Still another object of the present invention is to provide a smoke or heat detector capable of recording a vocal warning message and/or vocal instructions and transmitting the vocal warning message and/or vocal instructions as all or part of the fire alarm signal in response to detection of a fire condition.

DETAILED DESCRIPTION OF THE INVENTION

Figure 1:
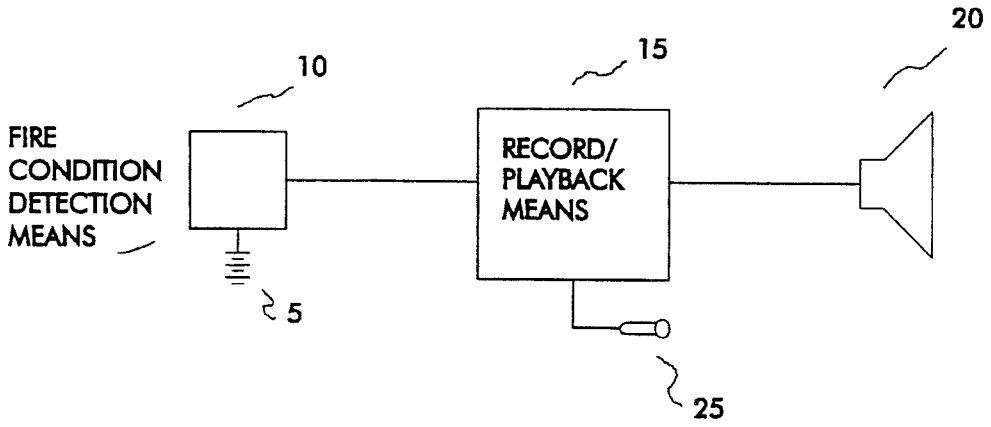
FIG. 1 is a generalized schematic illustration of the fire condition detector alarm system.

The fire condition detector and alarm system of the present invention encompasses means by which an end user, e.g. the parent of a small child or guardian of an elderly or other adult in need of simple instructions to react quickly and properly to an alarm, can record a vocal message specifically suited for his particular small child or adult, and further means by which the recorded vocal message can be transmitted as the whole or part of the alarm signal activated by the detection of a fire condition in the vicinity of the fire condition detector.

Definitions

The term "fire condition detector" as used herein refers to any means for detecting a fire condition within the premises in which the detecting device is located. Examples of fire condition detecting means are well known in the art and include smoke detecting means and heat detecting means. The term "alarm signal" or "warning signal" includes any warning sound, including a vocal warning message, to be transmitted by the fire condition detector and alarm system of the present invention. Thus, "alarm signal" encompasses buzzers, horns, sirens, and whistles as well as recorded vocal messages.

The present invention more specifically includes means for supplying electrical power, a fire condition detector, means for recording a vocal message, and playback means for transmitting the recorded message as part of the alarm signal. The fire condition detector and alarm system may optionally include a non-verbal alarm signal. For example, the fire condition detector and alarm may optionally have a pre-set or fixed alarm signal that sounds in addition to the recorded warning message signal. The alarm signal of such an embodiment would consist of both a fixed signal portion and a variable recorded warning message signal portion. Furthermore, the fixed and variable portions of the alarm signal may be transmitted in an alternating and repeating manner. The detector and alarm system of the present invention may also encompass a user controllable volume control means whereby the intensity of the alarm signal or warning signal may be enhanced or elevated for the hearing impaired. Such a volume control means may take the form of a single push button or switch for toggling the volume output of the system between a normal decibel level and an enhanced or increased decibel level. Alternatively, the optional volume control means may be continuously variable between a pre-set minimum normal output level and various increased output levels.

The means for supplying electrical power include 110 volt power from normal electrical circuits, such as a wall socket, and step-down transformers that provide the required voltage, e.g. 9 volts. Alternatively, the electrical power may be supplied by a replaceable battery, such as a 9 volt battery. The fire condition detecting means may be any of the detecting means known and used by those skilled in the art. For example, U.S. Pat. No. 4,453,222 to Goszyk, U.S. Pat. No. 4,904,988 to Nesbit et al. and U.S. Pat. No. 4,754,266 to Shand et al. describe smoke and/or heat detectors and relevant material contained therein is hereby incorporated by reference. Preferably the fire condition detecting means is a smoke or heat detector or a combination smoke and heat detector.

The means for recording a vocal message may be, for example a microphone and miniature tape recorder. A preferred recording means is a microphone, computer Central Processing Unit (CPU) for digitizing the message to be recorded, and digital memory device such as a Random Access Memory (RAM) for recording and storing the digitized warning message. Other recording means known in the art are equally applicable to the present invention and are intended to fall within the scope of the appended claims.

The playback means may be by a tape playback mechanism and audio speaker. A preferable playback means is a CPU, RAM, a digital sound generator and an audio speaker. The audio speaker may be any of the speakers known to those skilled in the art suitable for the transmission of audio alarm signals and warning signals. The microphone may be any of the microphones known to those skilled in the art suitable for the recording of vocal warning messages by recording means encompassed in the present invention.

The present invention additionally may encompass a fixed alarm signal such as any of the horn, siren or shrill buzzer devices currently known to those skilled in the art. Alternatively, a Read Only Memory (ROM) device having a fixed warning message so as to produce and transmit an computer generated vocal alarm signal consisting of a fixed portion, e.g. "WARNING! DANGER!" or a fixed or alternating tone, may be part of the present invention. The fixed and variable portions of the alarm signal may be transmitted in an alternating and repeating manner.

Embodiments of fire condition detector alarm systems according to the present invention will now be described with reference to the accompanying Figures.

FIG. 1 illustrates generally a fire alarm system encompassing means 5 for supplying power to fire condition detecting means 10, recording/playback means 15, a speaker 20 for transmitting the alarm signal, and a microphone 25 for recording the variable warning message portion of the alarm signal. Fire condition detector means 10, powered by power supply means 5, is connected to recorder and playback means 15, which in turn is connected to speaker 20. Detection of a fire condition by fire condition detecting means 10 actuates recording/playback means 15, which in turn transmits an alarm signal via speaker 20. Alarm signal warning messages are recorded via microphone 25, which is connected to recording/playback means 15.

Figure 2:
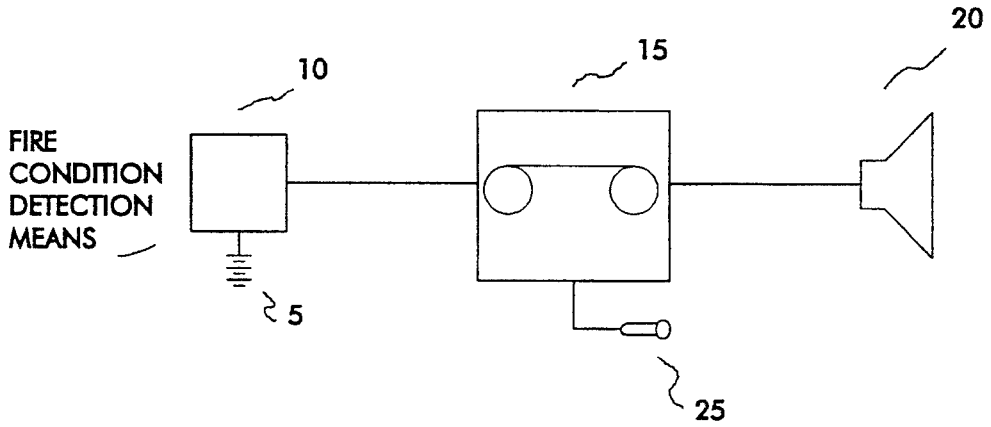
FIG. 2 is a schematic illustration of a first embodiment having a tape recorder and playback means.

FIG. 2 illustrates an embodiment in which recorder/playback means 15 is a tape recorder and playback mechanism. Any of the tape recorder and playback mechanisms known to those skilled in the art are suitable for use in the present invention, though miniature or micro tape recorder and playback mechanisms are preferred. More preferably still, a micro tape record and playback mechanism, such as those used in telephone answering machines, that automatically rewinds and plays the tape would be used to transmit repetitively the recorded warning message.

Figure 3:
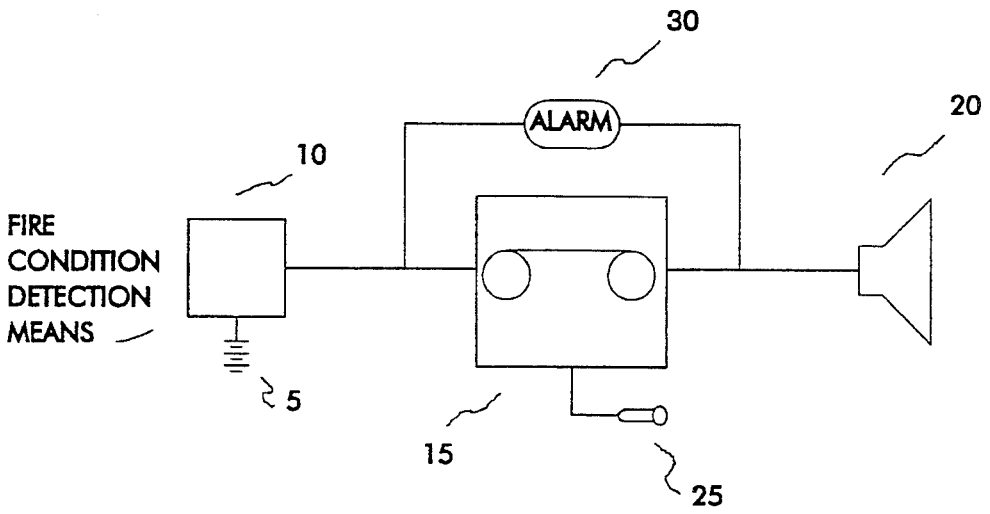
FIG. 3 is a schematic illustration of an embodiment having a tape recorder and playback means, and an additional alarm that generates a fixed signal.

FIG. 3 illustrates yet another embodiment in which a fixed alarm 30 is connected to fire condition detecting means 10 and speaker 20. Any of the alarms known to those skilled in the art may be used. Examples of such alarms include, buzzers, horns, and sirens. Such an alarm signal may be transmitted concurrently, or more preferably may be transmitted alternatively with the variable recorded message.

Figure 4:
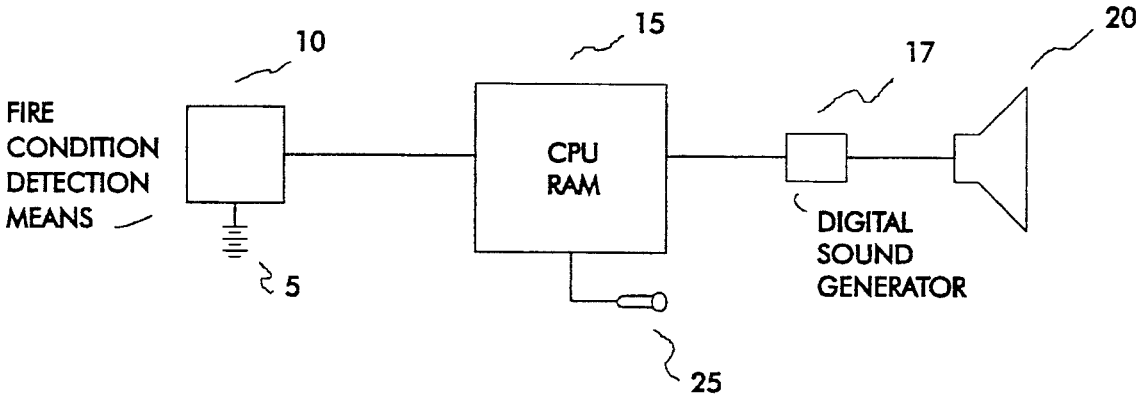
FIG. 4 is a schematic illustration of a yet another embodiment having a CPU, sound digitizer and RAM storage device as the recording and playback means.

FIG. 4 illustrates another embodiment in which recorder/playback means 15 includes a CPU chip, Random Access Memory (RAM) for storage of the recorded warning message in digital format, and a Digital Sound Generator 17 for the conversions of the digital recording to analog signal for transmission by speaker 20.

Figure 5:
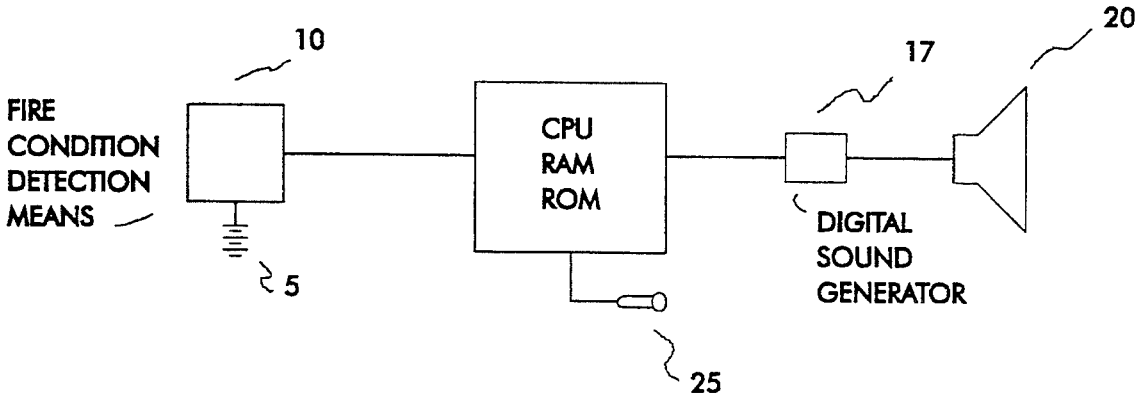
FIG. 5 is a schematic illustration of a third embodiment having a CPU, ROM, sound digitizer, and RAM storage device as the recording and playback means.

FIG. 5 illustrates a preferred embodiment in which recorder/playback means 15 is a computer central processing unit (CPU) chip, Random Access Memory (RAM) for storage of the recorded warning message in digital format, Read Only Memory (ROM) for the storage of a fixed signal, and a Digital Sound Generator 17 for the conversions of the digital recordings (both the fixed alarm signal stored in ROM and the variable alarm signal stored in RAM) to analog signal for transmission by speaker 20.

Figure 6:
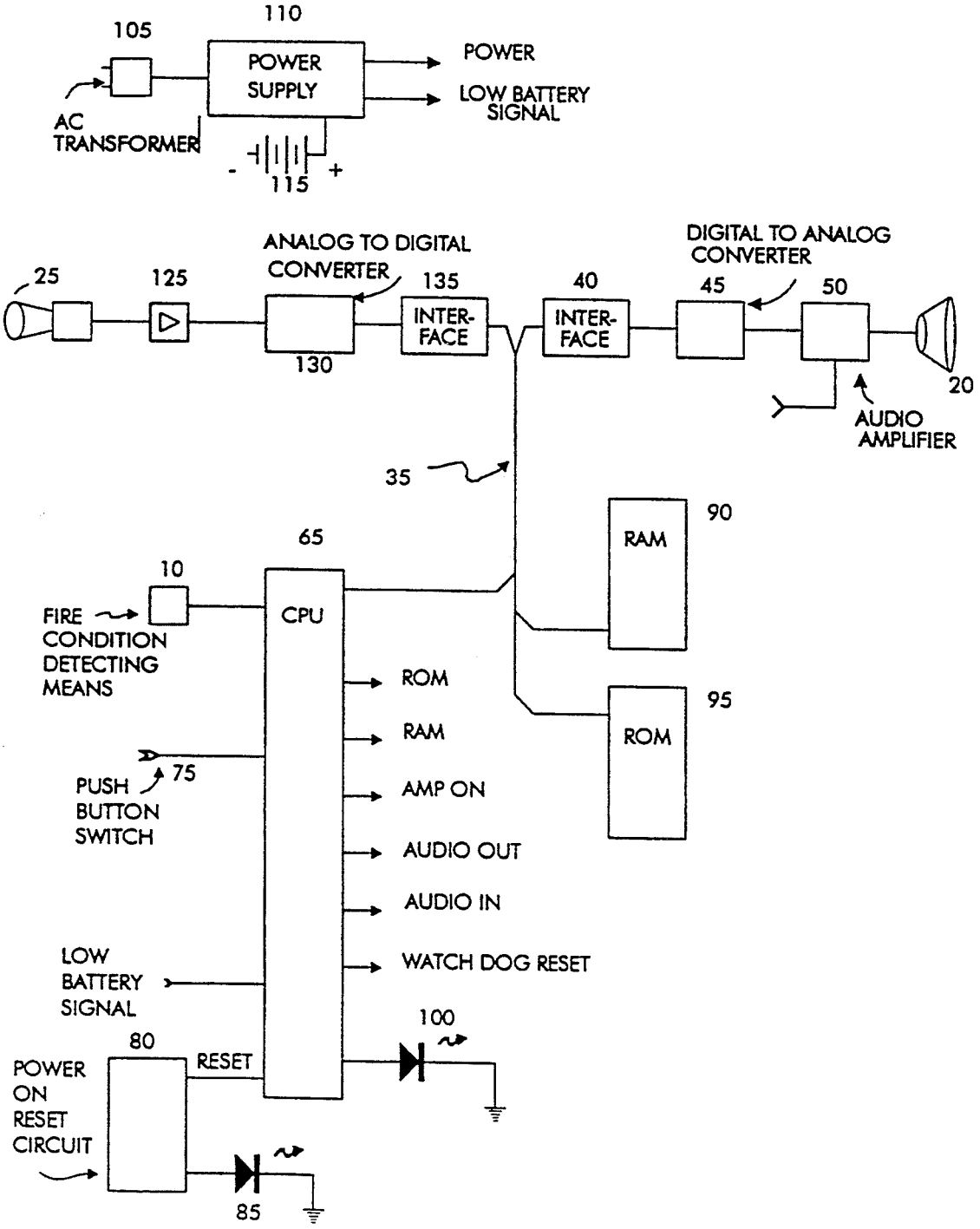
FIG. 6 is a schematic illustration of a preferred embodiment of a recording digital fire condition detector of the present invention.

FIG. 6 illustrates a more detailed block diagram form of a preferred embodiment of the invention. The fire alarm system normally is powered by an AC transformer 105 that provides 9 volts AC to power supply 110, which converts the 9 volts AC to the necessary DC voltage required by the electrical components of the detector and alarm system. In the event of loss-of-power, the detector and alarm system may be battery backed-up with one or more standard replaceable 9 volt DC batteries 115. If the battery voltage falls below a pre-set threshold, a low battery signal is asserted, as discussed more fully below.

The detector is controlled by the CPU and its associated control circuitry 65. Upon initial power-up of the detector and alarm system, the combined watch-dog timer and power-on-reset circuitry 80 toggles the reset signal of CPU 65 which resets CPU 65 and allows CPU 65 to execute machine instructions that are contained within the system's read-only-memory (ROM) 95. The stack and other read-write memory used by CPU 6 5 are located in RAM 90. Most digital components of the system interface to CPU 65 through CPU bus 35.

All user commands to the detector and alarm system are issued using a single-pole momentary push-button switch 75 that is located such that it is not easily depressed. Upon pushing switch 75 and holding it for a time greater than four seconds, CPU 65 goes into to a pre-recording state. Once in this state, CPU 65 controls green LED 100 such that it flashes repetitively on for 500 milliseconds and off for 500 milliseconds. Also during this time CPU 65 asserts the amplifier enable signal that turns on audio amplifier 50 which provides an audio signal to loudspeaker 20. CPU 65, using information from ROM 95, sends information to the digital-to-analog CPU bus interface 40. This information is then converted to an analog signal by the digital-to-analog converter 45 such that the analog signal applied to the amplifier generates a 1000 Hz tone as the green LED 100 is illuminated.

The combination of the flashing green LED 100 and pulsating audio tone informs the user that the detector and alarm system is in the pre-record state. Once the push-button switch 75 is released, the green LED 100 is turned on for two seconds and CPU 65 controls the necessary circuit such that a two second tone of 1500 Hz is transmitted by loudspeaker 20 during the two seconds that LED 100 is illuminated. After the two second interval has expired, CPU 65 turns LED 100 off and CPU 65 enters a recording state. While in the recording state the user speaks into microphone 25 which applies an audio signal to the microphone amplifier 125 which in turn sends an analog signal to the analog-to-digital converter 130 which in turn sends a digital signal to the analog-to-digital converter CPU bus interface 135. CPU 65 reads the digitized signal from the analog-to-digital converter CPU bus interface 135, and stores the digital information in RAM 90. The CPU 65 recording state is terminated after a pre-set recording length, for example approximately 10 seconds. As part of the recording process, CPU 65 computes a check-sum of the digital data representing the recorded vocal warning message. This check-sum is also stored in RAM 90.

Immediately after the recording state is terminated, CPU 65 gives a confirmation signal to the user by turning green LED 100 on for one second and sending a 1000 Hz tone to loudspeaker 60. After this confirmation signal is generated, CPU 65 enters its normal monitoring state. While in the monitoring state, CPU 65 monitors the output of the fire condition detecting means 10. Upon detection of a fire condition, the fire condition detecting means 10 asserts a signal which instructs CPU 65 to enter the alarm state. In the alarm state, CPU 65 asserts the amplifier enable signal that turns on audio amplifier 50. CPU 65 then transfers the pre recorded digital information of the previously recorded vocal warning message from RAM 90 to the digital-to-analog CPU bus interface 40. The vocal warning message is repeated for as long as the fire condition detecting means signal output is asserted. Once the fire condition detecting means output is no longer asserted, CPU 65 will disable the amplifier enable signal and discontinue sending the digitized vocal warning message to the digital-to-analog CPU bus interface 40.

While the fire condition detector and alarm system is in the monitoring state, it flashes green LED 100 on for 200 milliseconds every five seconds. This short flash informs the user that the system is working properly. Also, during this monitoring state, CPU 65 checks the digital data representing the vocal warning message and computes that data's check-sum. If the check-sum differs from what was determined when the recording was originally made, the system goes to a failure mode where LED 100 is turned off and the audio message "record" that is pre-recorded in ROM 95 is played through loudspeaker 20 every fifteen seconds. Because this check-sum will not be defined upon first powering the detector and alarm system, it will enter this failure mode sate which will remind the user to record the required vocal warning message.

While the detector and alarm system is in the monitoring state, it will apply a signal to the watch-dog timer 80 every two seconds. The watch-dog timer contains circuitry such that if this signal is not detected for a period of greater than five seconds, it will turn on the red LED 85 and toggle the reset signal of CPU 65. The red LED 85 will not be turned off until the watch-dog timer detects CPU 65 accessing the watch-dog timer. If the voltage of batteries 115 falls below a pre-determined voltage, the low battery signal is asserted, which causes CPU 65 to turn off the green LED 100 and play the audio message "low battery" which is prerecorded in ROM 95.

The preferred embodiments described above are merely descriptive of the present invention, and are in no way intended to limit the scope of the invention. Modifications of the present invention will become obvious to those skilled in the art in light of the detailed description above, and such modifications are intended to fall within the scope of the appended claims.

We claim:

1. A fire alarm system for recording and playing back to a first person a message recorded by a second person who is familiar to said first person, said message being at least one of a verbal warning or verbal instructions comprising:

fire condition detector means responsive to fire conditions, for generating an activating signal;

recorder and playback means connected to said fire condition detector means, for recording said message from said familiar second person in the voice of said familiar second person, and playing back said message for said first person when said activating signal is received from said fire condition detector means;

a microphone connected to said recorder and playback means for recording said message from said familiar second person in said voice of said familiar second person; and a speaker connected to said recorder and playback means for transmitting to said first person said message played back by said recorder and playback means.

2. The fire alarm system of claim 1, wherein said recorder and playback means comprises a tape recorder and playback mechanism.

3. The fire alarm of claim 1, further comprising:

fixed alarm means responsive to said activating signal for sending a fixed alarm signal to said speaker, wherein both said fixed alarm signal and said warning message are transmitted by said speaker.

4. The fire alarm system of claim 3, wherein said fixed alarm signal is selected from the group consisting of a horn, siren, buzzer, and tone.

5. The fire alarm system of claim 1, wherein said recorder and playback means comprises:

a Random Access Memory (RAM) for storing a digitized warning message;

a Digital Sound Generator for receiving and converting said digitized warning message into an analog signal and providing said analog signal to said loudspeaker; and a processor for receiving said warning message from said microphone and converting said warning message into said digitized warning message, for storing said digitized warning message into said RAM, and for reading said digitized warning message from said RAM, providing said digitized warning message to said Digital Sound Generator.

6. The alarm system of claim 5, further comprising;

a Read Only Memory (ROM), said ROM containing a fixed alarm signal portion;

and wherein said processor further reads said fixed alarm signal form said ROM and provides said fixed alarm signal to said Digital Sound Generator, and said Digital Sound Generator converts said fixed alarm signal to an analog alarm signal and provides said analog alarm signal to said loudspeaker.

7. A method of using a fire alarm system which can record a message and play back said message to a first person intended to hear said message, said message being at least one of a verbal warning or verbal instructions, comprising the steps of:

a) determining said first person who is intended to hear said message;

b) determining a second person who is familiar to said first person; and c) said familiar second person recording said message in said fire alarm system.

* * * * *